US008559274B2

(12) United States Patent
Huang

(10) Patent No.: US 8,559,274 B2
(45) Date of Patent: Oct. 15, 2013

(54) DUAL-MODE OPERATION MICROMACHINED ULTRASONIC TRANSDUCER

(75) Inventor: Yongli Huang, San Jose, CA (US)

(73) Assignee: KOLO Technologies, Inc., San Jose, CA (US)

( * ) Notice: Subject to any disclaimer, the term of this patent is extended or adjusted under 35 U.S.C. 154(b) by 502 days.

(21) Appl. No.: 12/745,737

(22) PCT Filed: Nov. 26, 2008

(86) PCT No.: PCT/US2008/085028

§ 371 (c)(1),
(2), (4) Date: Jun. 2, 2010

(87) PCT Pub. No.: WO2009/073562

PCT Pub. Date: Jun. 11, 2009

(65) Prior Publication Data

US 2010/0254222 A1 Oct. 7, 2010

Related U.S. Application Data

(60) Provisional application No. 60/992,038, filed on Dec. 3, 2007.

(51) Int. Cl.
*B06B 1/06* (2006.01)
*B06B 1/02* (2006.01)

(52) U.S. Cl.
CPC ..... *B06B 1/0292* (2013.01)
USPC ..... 367/181

(58) Field of Classification Search
USPC ..... 367/181
See application file for complete search history.

(56) References Cited

U.S. PATENT DOCUMENTS

| | | | | |
|---|---|---|---|---|
| 6,010,461 | A | 1/2000 | Haniff et al. | |
| 6,359,367 | B1 | 3/2002 | Sumanaweera et al. | |
| 7,030,536 | B2 * | 4/2006 | Smith et al. | 310/309 |
| 7,257,051 | B2 * | 8/2007 | Thomenius et al. | 367/153 |
| 7,280,435 | B2 * | 10/2007 | Thomenius et al. | 367/153 |

(Continued)

FOREIGN PATENT DOCUMENTS

| | | |
|---|---|---|
| JP | 2006020313 | 1/2006 |
| JP | 2008546239 | 12/2008 |
| WO | WO2006123300 | 11/2006 |

OTHER PUBLICATIONS

International Search Report for PCT/US2008/085028, World Intellectual Property Organization, Jan. 23, 2009 (6 pages).*

(Continued)

*Primary Examiner* — Isam Alsomiri
*Assistant Examiner* — James Hulka
(74) *Attorney, Agent, or Firm* — Lee & Hayes, PLLC

(57) ABSTRACT

Implementations of a cMUT have dual operation modes. The cMUT has two different switchable operating conditions depending on whether a spring member in the cMUT contacts an opposing surface at a contact point in the cMUT. The two different operating conditions have different frequency responses due to the contact. The cMUT can be configured to operate in transmission mode when the cMUT in the first operating condition and to operate in reception mode when the cMUT is in the second operating condition. The implementations of the dual operation mode cMUT are particularly suitable for ultrasonic harmonic imaging in which the reception mode receives higher harmonic frequencies.

24 Claims, 11 Drawing Sheets

(56) References Cited

U.S. PATENT DOCUMENTS

| | | | | |
|---|---|---|---|---|
| 2004/0059220 | A1 | 3/2004 | Mourad et al. | |
| 2004/0085858 | A1 | 5/2004 | Khuri-Yakub et al. | |
| 2005/0094490 | A1* | 5/2005 | Thomenius et al. | 367/155 |
| 2005/0169107 | A1* | 8/2005 | Thomenius et al. | 367/155 |
| 2005/0215909 | A1 | 9/2005 | Barnes | |
| 2005/0228285 | A1* | 10/2005 | Huang et al. | 600/459 |
| 2006/0004289 | A1 | 1/2006 | Tian et al. | |
| 2006/0075818 | A1 | 4/2006 | Huang et al. | |
| 2006/0181712 | A1* | 8/2006 | Degertekin et al. | 356/505 |
| 2007/0013269 | A1 | 1/2007 | Huang | |
| 2007/0046396 | A1 | 3/2007 | Huang | |
| 2007/0215964 | A1 | 9/2007 | Khuri-Yakub et al. | |
| 2007/0228877 | A1 | 10/2007 | Huang | |
| 2007/0228878 | A1 | 10/2007 | Huang | |
| 2007/0258332 | A1 | 11/2007 | Stuart Savoia et al. | |
| 2007/0287918 | A1 | 12/2007 | Huang | |
| 2008/0194053 | A1 | 8/2008 | Huang | |
| 2008/0197751 | A1 | 8/2008 | Huang | |
| 2008/0203556 | A1 | 8/2008 | Huang | |
| 2008/0290756 | A1 | 11/2008 | Huang | |
| 2009/0140606 | A1 | 6/2009 | Huang | |
| 2009/0152980 | A1 | 6/2009 | Huang | |

OTHER PUBLICATIONS

Chinese Office Action mailed Aug. 3, 2012 for Chinese patent application No. 200880118677.8, a counterpart foreign application of U.S. Appl. No. 12/745,737, 10 pages.

Chinese Office Action mailed Feb. 22, 2012 for Chinese patent application No. 200880118677.8, a counterpart foreign application of U.S. Appl. No. 12/745,737, 9 pages.

Japanese Office Action mailed Dec. 7, 2012 for Japanese patent application No. 2010-536195, a counterpart foreign application of U.S. Appl. No. 12/745,737, 4 pages.

* cited by examiner

500
SWITCH SIGNAL
VOLTAGE
R
RT
T
TR
R
RT
T
TR
R
V2
V1
TIME
T: TX DURATION
R: RX DURATION
RT: RX TO TX TRANSITION
TR: TX TO RX TRANSITION

600A
BIAS SIGNAL
VOLTAGE
R
RT
T
TR
R
RT
T
TR
R
V2
V1
TIME

600B
TX INPUT SIGNAL
VOLTAGE
R
RT
T
TR
R
RT
T
TR
R
0
TIME

DUAL-MODE OPERATION MICROMACHINED ULTRASONIC TRANSDUCER

RELATED APPLICATIONS

This application claims priority benefit of U.S. Provisional Patent Application No. 60/992,038 entitled "OPERATION OF MICROMACHINED ULTRASONIC TRANSDUCERS", filed on Dec. 3, 2007, which application is hereby incorporated by reference in its entirety.

BACKGROUND

Capacitive micromachined ultrasonic transducers (cMUTs) are electrostatic actuators/transducers, which are widely used in various applications. Ultrasonic transducers can operate in a variety of media including liquids, solids and gas. Ultrasonic transducers are commonly used for medical imaging for diagnostics and therapy, biochemical imaging, non-destructive evaluation of materials, sonar, communication, proximity sensors, gas flow measurements, in-situ process monitoring, acoustic microscopy, underwater sensing and imaging, and numerous other practical applications. A typical structure of a cMUT is a parallel plate capacitor with a rigid bottom electrode and a movable top electrode residing on or within a flexible membrane, which is used to transmit/accurate (TX) or receive/detect (RX) an acoustic wave in an adjacent medium. A direct current (DC) bias voltage may be applied between the electrodes to deflect the membrane to an optimum position for cMUT operation, usually with the goal of maximizing sensitivity and bandwidth. During transmission an alternating current (AC) signal is applied to the transducer. The alternating electrostatic force between the top electrode and the bottom electrode actuates the membrane in order to deliver acoustic energy into the medium surrounding the cMUT. During reception an impinging acoustic wave causes the membrane to vibrate, thus altering the capacitance between the two electrodes.

One of the most important characteristics of a cMUT is its frequency response. Existing cMUTs each has its own characteristic frequency response spanning a single frequency band. If the same transducer or transducer array is used for TX and RX operation, the frequency response of the transducer in the TX and RX operations are the same or nearly the same. This makes it difficult to avoid interference between the TX operation mode and the RX operation mode.

SUMMARY

Implementations of a cMUT having dual operation modes are disclosed. The cMUT has two different switchable operating conditions depending on whether a spring member in the cMUT contacts a contact point in the cMUT. The two different operating conditions have different frequency responses due to the contact with the contact point. The cMUT can be configured to operate in transmission mode when the cMUT is in the first operating condition and to operate in reception mode when the cMUT is in the second operating condition.

One aspect of the disclosure is a cMUT including a first electrode and a second electrode separated from the first electrode by an electrode gap so that a capacitance exists between the first electrode and the second electrode. A spring member supports the second electrode for enabling the first electrode and the second electrode to move toward or away from each other. The cMUT has a contact structure defining two different operating conditions of the cMUT. In the first operating condition of the cMUT, the contact structure does not connect the spring member with an opposing surface facing the spring member. But in the second operating condition, the contact structure connects the spring member with the opposing surface facing the spring member, so that the cMUT has a first frequency response in the first operating condition and a second frequency response in the second operating condition. The first frequency response and the second frequency response are substantially different from each other. A switch means is adapted for switching the cMUT between the first operating condition and the second operating condition. The first operating condition is in one of a transmission mode and a reception mode, and the second operating condition is in the other one of the transmission mode and the reception mode.

In one embodiment, the first frequency response is characterized by a first frequency band, and the second frequency response is characterized by a second frequency band substantially shifted toward a higher frequency relative to the first frequency band. The transmission mode is in the first operating condition, and the reception mode is in the second operating condition.

In operation, the first operating condition is characterized by a first operating voltage, and the second operating condition is characterized by a second operating voltage which may be higher than the first operating voltage.

The cMUT can be a membrane-based cMUT in which the spring member (e.g., a membrane) is space from the first electrode and moves together with the second electrode in the electrode gap during operation, and the contact structure has a stopper connected to either one of the first electrode and the second electrode to define a narrower gap between the stopper and the other one of the first electrode and the second electrode. The contact structure may also have two or more similar stoppers spaced from one another.

The cMUT can be an embedded-spring cMUT (EScMUT) in which the spring member is connected to the first electrode, the second electrode is suspended from the spring member by a support member to define the electrode gap, and the spring member moves in a spring cavity on an opposite side of the spring member relative to the electrode gap during operation. The contact structure includes a stopper connected to one of the spring member and an opposing side of the spring cavity to define a narrower gap between the stopper and the other one of the spring member and the opposing side of the spring cavity. The contact structure may also have two or more similar stoppers spaced from one another.

Another aspect of this disclosure is a method for operating cMUT. The method provides a capacitive micromachined ultrasonic transducer (cMUT) including a spring member for enabling a first electrode and a second electrode to move toward and away from each other. The cMUT has a contact point that defines two different operating conditions. The contact point does not connect the spring member with an opposing surface facing the spring member in a first operating condition of the cMUT, but connects the spring member with an opposing surface facing the spring member in a second operating condition, so that the cMUT has a first frequency response in the first operating condition and a second frequency response in the second operating condition. The method configures the cMUT so that the cMUT operates in a first operation mode (e.g., a transmission mode) when the cMUT is in the first operating condition, and operates in a second operation mode (e.g., the reception mode) when the cMUT is in the second operating condition. The method switches the cMUT between the first operating condition and the second operating condition.

The implementations of the dual operation mode cMUT are particularly suitable for ultrasonic harmonic imaging in which the reception mode receives higher harmonic frequencies.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE FIGURES

The detailed description is described with reference to the accompanying figures. In the figures, the left-most digit(s) of a reference number identifies the figure in which the reference number first appears. The use of the same reference numbers in different figures indicates similar or identical items.

DETAILED DESCRIPTION

The present disclosure discloses dual operation mode capacitive micromachined ultrasonic transducers (cMUT) and methods for operating such cMUTs. The methods configure a cMUT in different switchable operating conditions (e.g., different voltage levels) each corresponding to an operation mode, e.g. transmission (TX) and reception (RX) operations. Mechanical properties or acoustic properties of the cMUT are designed to be different in different operating conditions set for different operation modes such as TX and RX operations.

One of the exemplary applications of the disclosed cMUTs and operation methods is the popular ultrasound harmonic imaging. The disclosed cMUTs and operation methods potentially overcome several problems with existing techniques. In ultrasonic harmonic imaging, usually the transducer generates a desired acoustic output and emits it into a medium in TX operation and receives an echo signal from the medium in RX operation. A part of the received signal centers around a center frequency of the TX output (referred to as the fundamental frequency of the system) and another part of the received signal centers around the harmonic frequency region of the TX output (referred to as harmonic frequency of the system). The harmonic imaging method usually uses the harmonic part of the received signal to improve the imaging resolution. This is because the harmonic signal is at a higher frequency, where the acoustic wavelength is shorter, which enables better axial resolution.

The existing harmonic imaging techniques used the same transducer or transducer array having a single operating condition for both TX and RX operation. In these techniques, the frequency response of the transducer in the TX and RX operations are almost identical.

Figure 1:
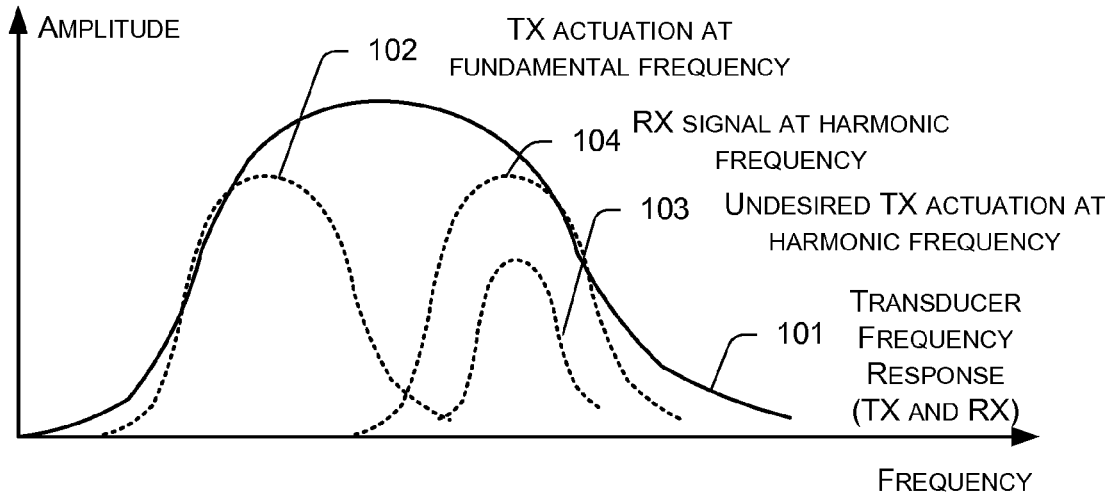
Fig. 1 (prior art)
FIG. 1 illustrates a frequency response (signal applicant vs. frequency curve) of a conventional cMUT used for harmonic imaging.

FIG. 1 illustrates a frequency response (signal applicant vs. frequency curve) of a conventional cMUT used for harmonic imaging. As shown in FIG. 1, the transducer/system has an overall frequency response band 101 cover both TX mode and RX mode. In harmonic imaging, the TX operation has a TX actuation 102 which is at a fundamental frequency occupying the lower part of the overall frequency response band 101 of the transducer/system, while the RX operation has a RX signal 104 at a harmonic frequency occupying the full or higher part of the frequency response band 101 of the transducer/system. This sharing of the same frequency band requires the TX operation to emit very minimal output signal in the harmonic frequency region so that TX output signal will not interfere with the received RX harmonic signal.

However, it is difficult to avoid or minimize the output signal in the harmonic frequency region using the existing techniques. The electrostatic actuation (pressure/force) generated by a cMUT is not linear to the applied voltage. For cMUT TX operation, usually a DC voltage and a relatively large AC voltage are used. This combination generates a desired electrostatic TX actuation 102 at the fundamental frequency of the system, but also generates a fairly large undesired TX actuation 103 around the harmonic frequency of the system. In other words, since the cMUT frequency response 101 of a conventional cMUT covers both fundamental and harmonic frequency regions, the cMUT has a quite large undesired output resulted from the undesired TX actuation 103 around the harmonic frequency of the system. Such a condition is usually not acceptable for ultrasound harmonic imaging application. In a normal cMUT operating condition, varying the bias voltage may change the frequency response of the cMUT slightly, but the frequency shift due to this change is too small to have any meaningful effect in the context of the interference problem. In other words, in a normal cMUT operation of a conventional cMUT, both TX and RX share a nearly identical frequency response.

To address the above problems, the present disclosure discloses a dual-mode operation method for operating a cMUT and various designs of a cMUT suited for the dual-mode operation methods. In the following, descriptions of the frequency response of the dual-mode cMUT, the switching methods for the dual-mode operation, and the various designs of the cMUT suited for the dual-mode operation are first provided, followed by a description of the dual-mode operation methods and their applications. In this description, the order in which a process is described is not intended to be construed as a limitation, and any number of the described process blocks may be combined in any order to implement the method, or an alternate method.

As will be shown herein, the operating conditions of the cMUT may be achieved and/or maintained using any suitable means, such as applying various voltage levels. The voltage levels applied on the cMUT can be set by the bias signal only or any combination of the bias signal and TX input signal.

Figure 2:
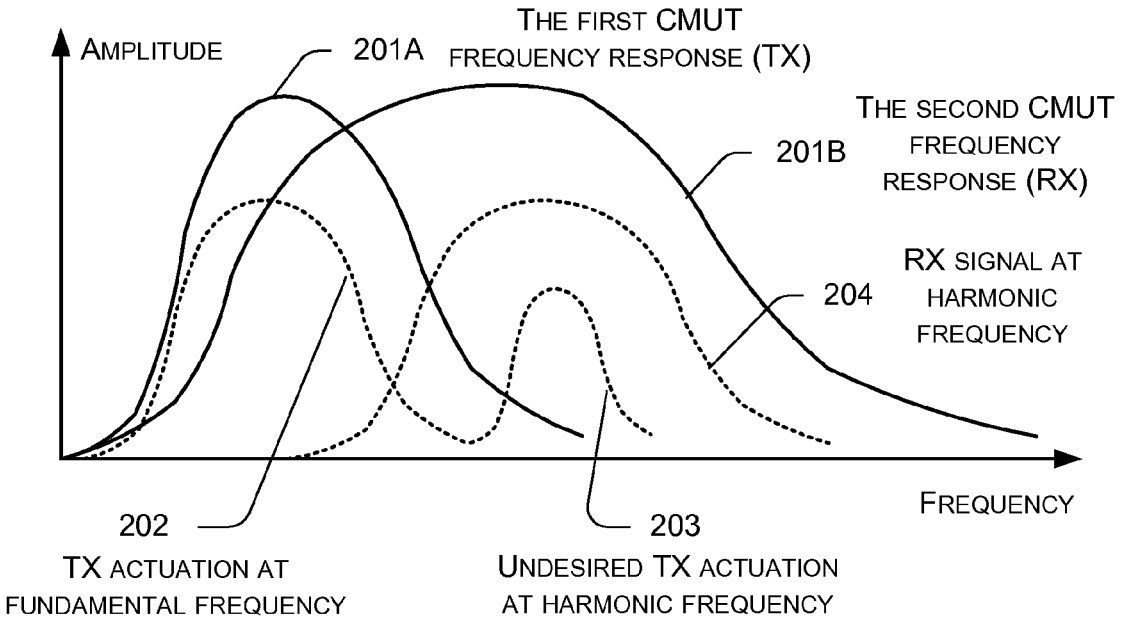
FIG. 2 illustrates a frequency response (signal applicant vs. frequency curve) of a dual-mode operation cMUT in accordance with the present disclosure.

FIG. 2 illustrates a frequency response (signal applicant vs. frequency curve) of a dual-mode operation cMUT in accordance with the present disclosure. The dual-mode operation cMUT has two different frequency responses. A first frequency response 201A corresponds to the first operating condition. A second frequency response 201B corresponds to the second operating condition. The first frequency response 201A of the first operating condition has a center frequency around the fundamental frequency, and the second frequency response 201B has a center frequency around the harmonic frequency of the ultrasound system. This offers an opportunity to reduce interface caused by the undesired output at the harmonic frequency.

For example, the TX operating condition of the cMUT may be set to have its center frequency around the fundamental frequency of the ultrasound system and the RX operating condition of the cMUT may be set to have its center frequency around the harmonic frequency of the ultrasound system. As shown in FIG. 2, the electrostatic actuation may still generate electrostatic pressure/force at both the desired fundamental (TX actuation 202) and undesired harmonic frequency regions (undesired TX actuation 203). However, in the TX mode the cMUT responses to the TX actuation 202 and the undesired TX actuation 203 according to the first frequency response 201A. Because the cMUT in a TX operating condition can be designed to have very small response at harmonic frequency region, the undesired TX actuation 203 generates very little actual interference.

In essence, the cMUT in TX operating condition functions like a filter to block out undesired harmonic frequency components in acoustic output, so that the harmonic component in the cMUT TX output can be controlled to a desirably low level for harmonic imaging application. In contrast, when the cMUT is in RX mode, the cMUT response to the RX signal 204 at harmonic frequency according to be second cMUT frequency response 201B which is shifted toward higher frequency region (the harmonic frequency region) relative to the first cMUT frequency response 201A in the TX mode. Because the cMUT in RX is set in different operating condition where the cMUT has good response in the harmonic frequency region, the cMUT still has good sensitivity for harmonic detection.

As will be shown, the cMUT has a moving component, such as a spring member or a surface plate. The spring member can be a flexible membrane, or an embedded spring member (e.g., a spring membrane). In one embodiment, the first operating condition of the cMUT is its normal operating condition, while the second operating condition of the cMUT is a contact operating condition in which a portion of the moving member of the cMUT is connected to an opposing surface these facing the moving part through a contacting point in the cMUT. The contacting point may be located on the opposing surface facing the movement part (e.g., a surface of the cavity in which the moving component moves). The contacting point may either be a point on the spring member or the opposing surface facing this member, or a point on a specially designed contact structure or object disposed of this member or the opposing surface. Multiple contacting points, contact structures or contact objects may be used. For example, a designed contact structure may be featured either on the bottom surface of the cavity or bottom surface of the moving member to determine the contact position(s), which in turn define different operating conditions based on changing the mechanical boundary condition of the moving member of the cMUT from one condition to another.

The cMUT has different mechanical properties or frequency responses in different operating conditions. With this design, if the cMUT is configured to work in TX and RX operation modes in different operating conditions, the cMUT may have different frequency responses (e.g. different center frequencies, bandwidths and band-shapes, etc.) in TX and RX operations. For example, the first operating condition may have a frequency response with the center frequency around the fundamental frequency, while the second operating condition may have a frequency response with a center frequency near the harmonic frequency of the ultrasound system. Accordingly, the TX operation of the cMUT may be set to have its center frequency around the fundamental frequency of the ultrasound system and the RX operating condition of the cMUT may be set to have its center frequency around the harmonic frequency of the ultrasound system. This differentiation in the frequency response between the TX operation and the RX operation helps to reduce the unwanted response to TX actuation as illustrated in FIG. 2.

Figure 3A:
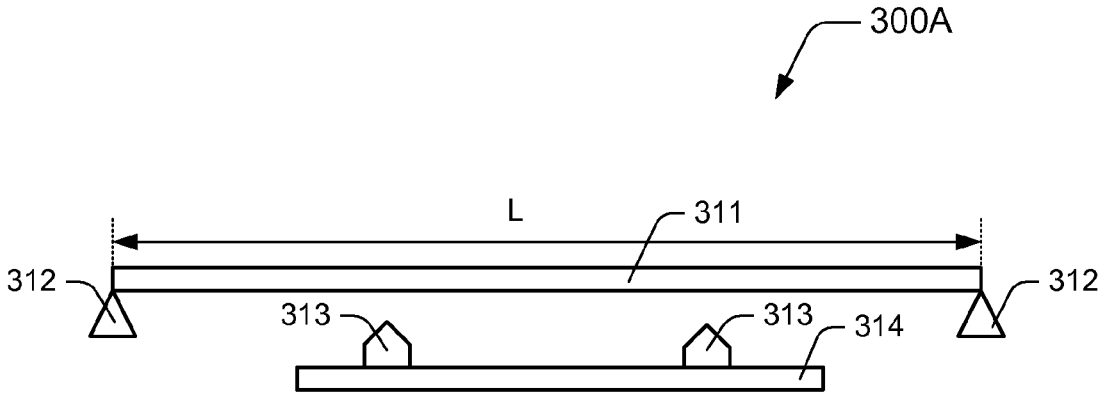
FIGS. 3A and 3B illustrate a first exemplary embodiment of the dual-mode cMUT having two different operating conditions.
Figure 3B:
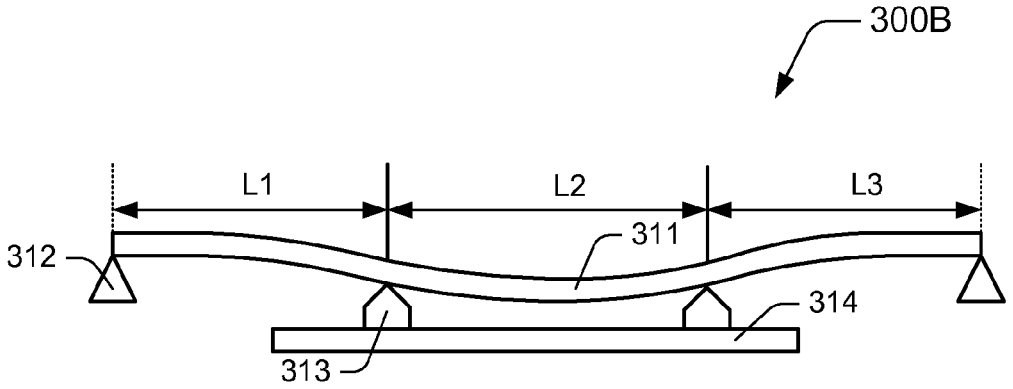

FIGS. 3A and 3B illustrate a first exemplary embodiment of the dual-mode cMUT having two different operating conditions. The cMUT is shown in two different operating conditions 300A and 300B. The first operating condition 300A is a normal operating condition before making a contact. The second operating condition 300B of the same cMUT is a contact operating condition after making a contact.

The cMUT has a moving member 311, anchors 312 supporting the moving member 311, and contact structures 313 disposed on a bottom surface 314 of a cMUT cavity. As will be illustrated in further embodiments, the cMUT has two electrodes (not shown). At least one of the electrodes is supported by moving member 311. The other electrode is separated from the first electrode by an electrode gap so that a capacitance exists between the first electrode and the second electrode. The moving member 311 enables the two electrodes to move toward or away from each other. The moving member 311 can be a spring member (such as a flexible membrane or a spring membrane), or a surface plate supported and moved by a spring member.

In the first operating condition 300A of the cMUT, the contact structures 313 do not connect the moving member 311 with the bottom surface 314 facing the moving member 311. In a second operating condition, the contact points 313 connect the moving member 311 with the bottom surface 314 facing the moving member 311. As a result of this change of physical boundary conditions, the cMUT has different frequency responses in the first operating condition and the second operating condition. In preferred embodiments, the first frequency response and the second frequency response are designed to be substantially different from each other.

Most specifically, in the normal operating condition 300A shown in FIG. 3A, the flexibility of moving member 311 in the cMUT is defined by the length L. In the contact operating condition 300B shown in FIG. 3B, the moving member 311 deforms or moves to contact with the contact structures 313 underneath. The flexibility of the cMUT in the contact operating condition 300B is now defined by the lengths L1, L2 and L3 because the contact between the moving member 311 and the contact structures 313 changes the boundary condition of the moving member 311. Because L is usually larger than L1, L2 and L3, the frequency response of the cMUT in the contact operating condition 300B is shifted toward higher frequencies relative to the normal operating condition 300A. Usually the operating condition with lower frequency response is preferred for TX operation and the operating condition with higher frequency response is preferred for RX operation. By properly selecting the frequency response of the cMUT in these two operating conditions 300A and 300B, the dual-mode cMUT may be well suitable to perform harmonic imaging.

As will be shown herein, in some embodiments, the cMUT is configured so that it operates in a first operation mode when the cMUT is in the first operating condition, and operates in a second operation mode when the cMUT is in the second operating condition. The cMUT is switched between the first operating condition and the second operating condition.

Figure 4A:
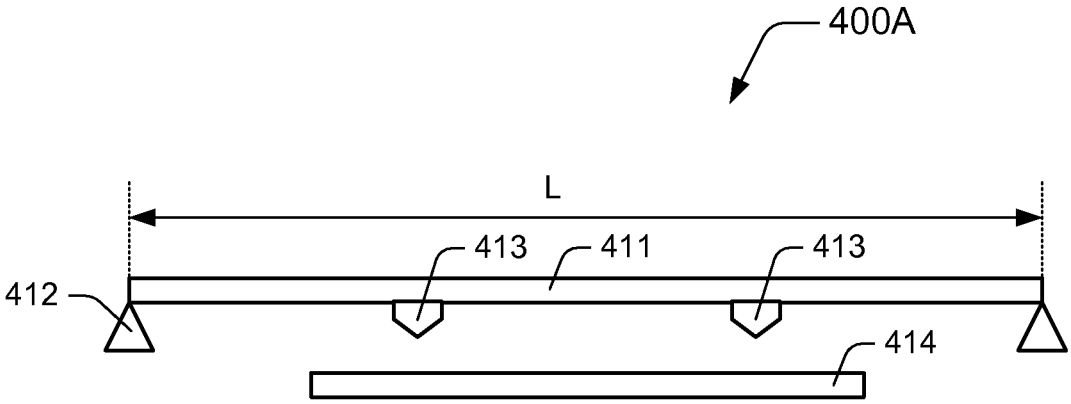
FIGS. 4A and 4B illustrate a second exemplary embodiment of the dual-mode cMUT having two different operating conditions.
Figure 4B:
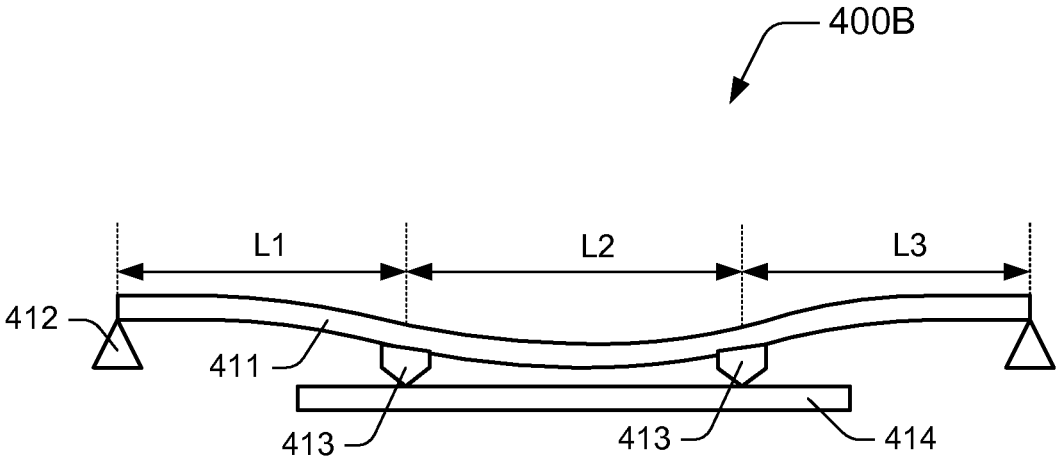

FIGS. 4A and 4B illustrate a second exemplary embodiment of the dual-mode cMUT having two different operating conditions. The cMUT of FIGS. 4A and 4B is similar to the cMUT of FIGS. 3A and 4B except for the locations of the contact structures. As shown in FIGS. 4A and 4B, the first operating condition 400A is a normal operating condition before making contact, and the second operating condition 400B of the same cMUT is a contact operating condition after making a contact. The cMUT has a moving member 411, anchors 412 supporting the moving member 411, and contact structures 413 disposed on a bottom surface of the moving member 411 of cMUT. A first electrode (not shown) and a second electrode (not shown) are separated from each other to define an electrode gap so that a capacitance exists between the first electrode and the second electrode. Despite the opposite location of the contact structures 413, the cMUT of FIGS. 4A and 4B has the same effect as that of the cMUT of FIGS. 3A and 3B.

The cMUTs of FIGS. 3A, 3B, 4A and 4B are just examples illustrating changing the mechanical properties of the cMUT by varying boundary conditions of a flexible member. More examples will be shown in a later section of this disclosure. The moving member (311 or 411) may be a flexible membrane, a cantilever or a bridge of various shapes. There may be one or multiple contact structures, which are located at desired locations below the moving member to achieve a desired frequency response in the contact operating condition. The contact between the moving member (311 or 411) and the contact structure (313 or 413), or the contact between the opposing surface (314 or 414) and the contact structure (313 or 413) may be a point, line or an area. Furthermore, the contact structure (313 or 413) may either be a specially designed structure or a natural part of the moving member or the opposing surface facing the moving member. The moving member and the opposing surface facing the moving member may either be flat or non-flat. The contact structures are designed to determine proper contact points to achieve a desired frequency response for the cMUT in the contact operating condition.

Switching Between the Dual-Mode Operations

The moving member (e.g., a flexible membrane, a spring membrane or a surface plate) of the cMUT may be switched from its normal operating condition to its contact operating condition or vice versa. The actual physical switch may be done through actuation using any suitable actuation methods such as electrostatic actuation, electromagnetic actuation, and thermal actuation. The electrostatic actuation may be done by applying a switch signal to set different voltage levels on the cMUT.

The switch signal applied on the cMUT is usually determined by either a bias signal on the cMUT only or a combination of the bias signal and a TX input signal. By choosing a proper bias signal and TX input signal, the switch signal applied on the cMUT can switch the cMUT between two operating conditions, for example the normal operating condition (300A or 400A) and contact operating condition (300B or 400B).

If the switch signal is formed by the bias signal only, the TX input signal is used to generate TX acoustic output only, so the TX input signal in this particular implementation is the same as that used in the convention cMUT operating methods. However, the bias signal used as the switch signal in this implementation would be an AC signal, and no longer a DC signal used in the convention cMUT operating methods. Therefore, there are two AC signals used in the dual-mode cMUT operation. In some preferred embodiments, the two AC signals are synchronized.

If the switch signal is formed by both the TX input signal and the bias signal, the bias signal can be a DC signal like that used in the convention cMUT operating methods. However, the TX input signal in this implementation would be different from that used in the convention cMUT operating methods. In this case, the TX input signal is not only to generate the desired ultrasound output, but can also be combined with the bias signal to form the switch signal to switch the cMUT operating conditions. Accordingly, in this implementation there is only one AC signal but the AC signal (the TX input signal) may include two components, one for acoustic output and another is for switching the operating conditions.

Figure 5:
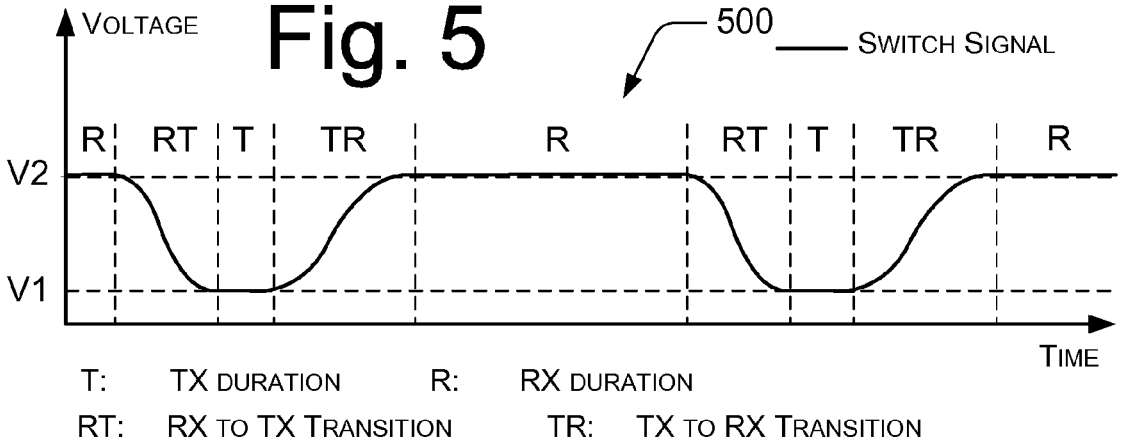
FIG. 5 shows an exemplary switch signal.

FIG. 5 shows an exemplary switch signal. The switch signal 500 is represented by a voltage/time graph. The switch signal 500 can be formed by a bias signal only or a combination of the bias signal and a TX input signal.

The switch signal 500 applied on the cMUT may include a TX duration and a RX duration. The cMUT performs as an ultrasound transmitter during TX duration and as an ultrasound receiver during RX duration. The voltage levels of the switch signal 500 are designed to be different in TX and RX operating conditions. Usually the absolute voltage level of the switch signal 500 applied on the cMUT in TX duration is lower than that applied in RX duration.

Including the transition periods, the switch signal may include four periods or durations: TX duration, RX duration, RX to TX transition, and TX to RX transition. These durations are denoted as "T", "R", "RT", and "TR", respectively in FIG. 5 and subsequent figures. Sometimes, one or two transition regions may merge with either RX or TX duration. The exemplary switch signal of FIG. 5 has different voltage levels V1 and V2 for transmission and reception operations, respectively. Usually, the switch voltage level V1 for transmission (TX) is lower than the switch voltage level V2 for reception (RX). The voltage levels in the switch signal determine the operating conditions in TX and RX operations.

Preferably, the switch signal 500 used for switching the operating conditions should not generate significant ultrasound actuation or signals in the frequency region of the ultrasound system to interfere with the TX output of the ultrasound system. The switch signal 500 therefore may be designed to have negligible frequency components in the operating frequency region or band (bandwidth) of the cMUT operation so that the switch signal 500 alone will not generate any meaningful ultrasound output in the CMUT operating frequency region during cMUT operation. The operating frequency region or band of the cMUT operation may include both TX operation and RX operation and is a frequency region in which the cMUT may transmit the ultrasound or extract the useful information from echo signal efficiently. Usually the frequency of switch signal 500 is lower than the frequency of the cMUT TX output, and further lower than the frequency of the cMUT RX signals.

The switch signal 500 may be first generated using a proper signal generator and then filtered using a proper low-pass or band-pass filter with cut-off frequency lower than the frequency region of the cMUT operations.

Figure 6A:
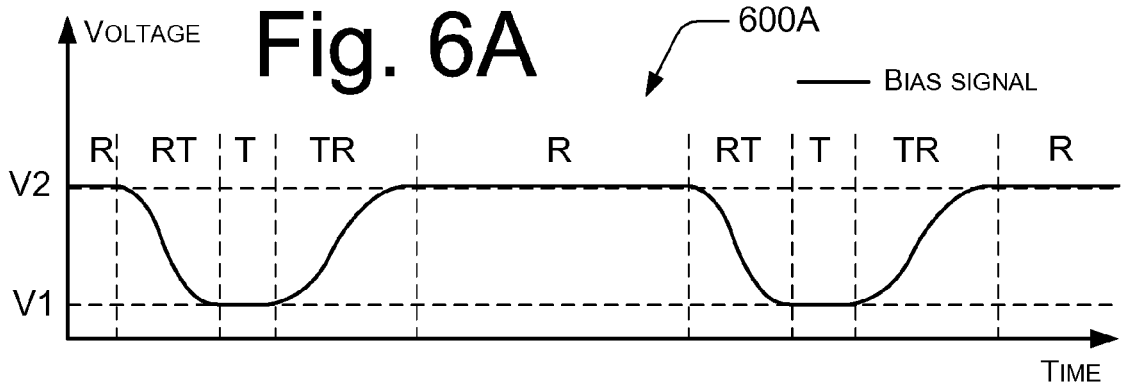
FIGS. 6A and 6B illustrate a first exemplary embodiment of forming a switch signal.
Figure 6B:
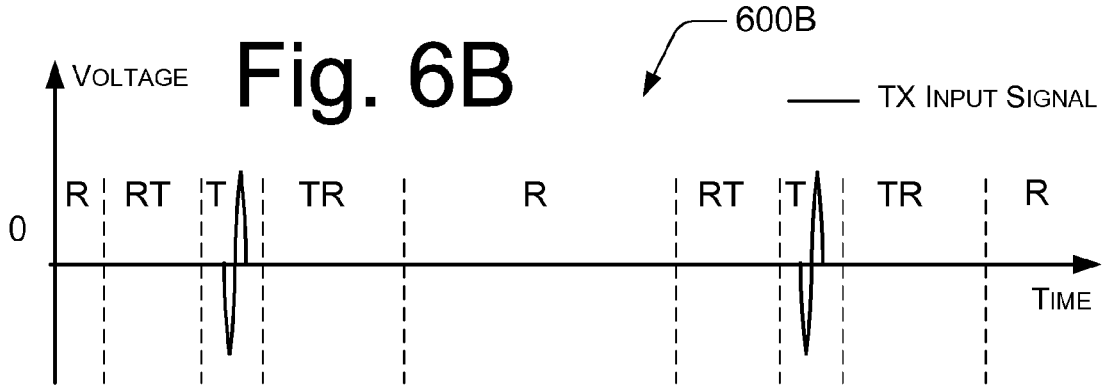

FIGS. 6A and 6B illustrate a first exemplary embodiment of forming a switch signal. In this embodiment, the switch signal is formed using a bias signal only. FIGS. 6A and 6B show an exemplary bias signal and an exemplary TX input signal, respectively. The bias signal 600A is represented by a voltage/time graph in FIG. 6A, and likewise the TX input signal 600B is represented by a voltage/time graph in FIG. 6B. The bias signal 600A of FIG. 6A alone is used to produce the switch signal 500 of FIG. 5. The exemplary bias signal 600A shown in FIG. 6A is the same as the switch signal 500 in FIG. 5 because in this exemplary implementation, the switch signal 500 is formed by the bias signal 600A only. In this case, the TX input signal 600B is only used to generate the acoustic output.

Figure 7A:
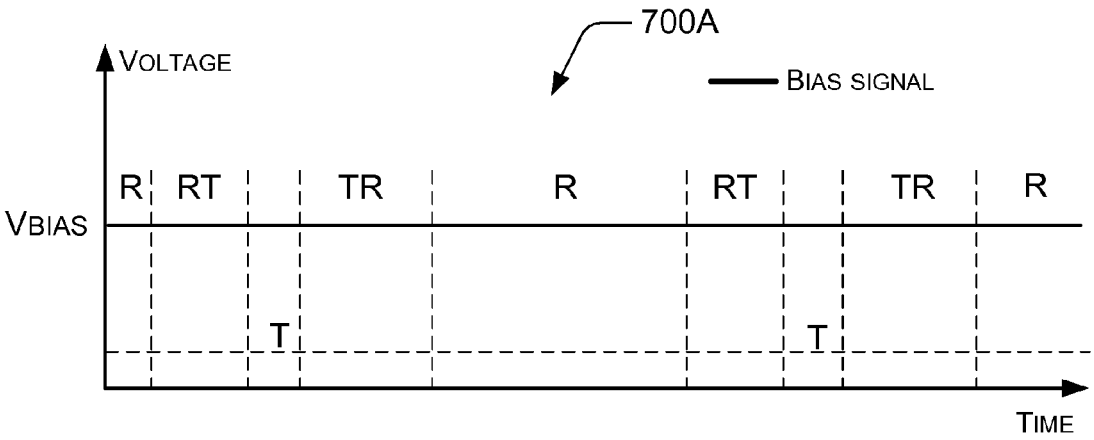
FIGS. 7A and 7B illustrate a second exemplary embodiment of forming a switch signal.
Figure 7B:
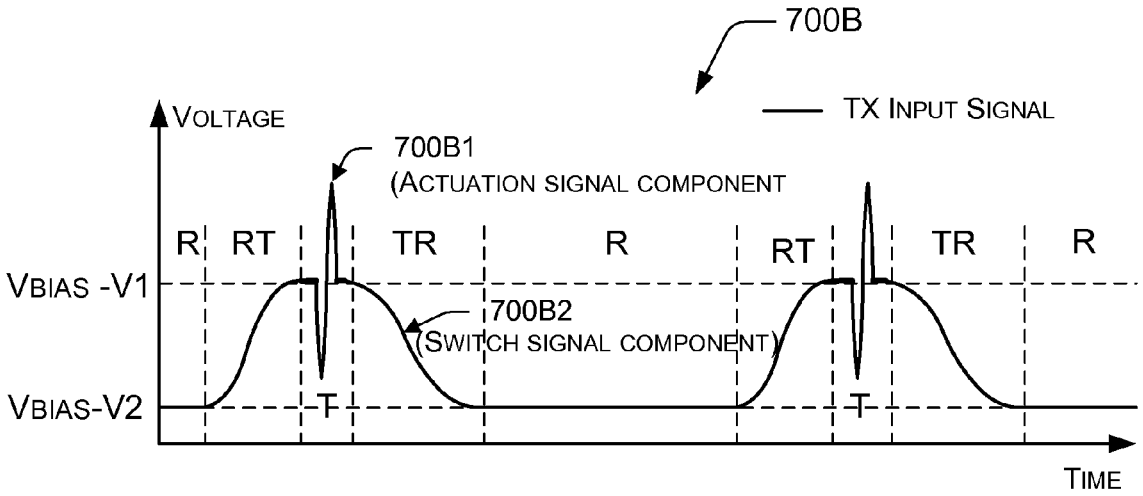

FIGS. 7A and 7B illustrate a second exemplary embodiment of forming a switch signal. In this embodiment, the switch signal is formed using a combination of a bias signal and a component of a TX input signal. FIGS. 7A and 7B show an exemplary bias signal and an exemplary TX input signal, respectively. The bias signal 700A is represented by a voltage/time graph in FIG. 7A, and likewise the TX input signal 700B is represented by a voltage/time graph in FIG. 7B. The bias signal 700A and the TX input signal 700B of FIGS. 7A and 7B are combined to produce the switch signal 500 of FIG. 5. In this implementation, the bias signal 700A is a DC signal. The TX input signal 700B has two components: an actuation signal component 700B1 and a switch signal component 700B2. The actuation signal component 700B1 may be the same as the TX input signal 600B shown in FIG. 6 and is used to generate the acoustic output. The switch signal component 700B2 is used together with the bias signal 700A to form a proper switch signal (e.g., switch signal 500) for switching the operating conditions. This is different from the bias signal 600A shown in FIG. 6, In this illustrated second exemplary embodiment, the switch signal shown in FIG. 5 can be obtained by subtracting the switch signal component 700B2 from the bias signal in FIG. 7A. In real implementation, the subtraction of the two signals can be done by applying the two signals on two opposite electrodes of the CMUT separately. Alternatively, the two signals (the bias signal and the switch signal component of the TX input signal) can be applied on the same side of the two electrodes of the CMUTs. In this alternative case, the switch signal is formed by addition of the bias signal and the switch signal component. But in this alternative implementation, the switch signal component in TX input signal may need to be designed differently from the switch signal component 700B2 shown in FIG.7 in order to obtain the same switch signal 500 shown in FIG. 5.

The above second exemplary embodiment of forming a switch signal may be potentially advantageous compared to the above first exemplary embodiment. In the first exemplary embodiment shown in FIGS. 6A and 6B, two AC signals (the AC bias signal 600A and the AC TX input signal 600B) are used for each cMUT element. These two AC signals may need to be synchronized. This configuration may require two separate wires for each cMUT element. In contrast, in the second exemplary embodiment shown in FIGS. 7A and 7B, only one AC signal (AC text input signal 700B) is used for each cMUT element. This may result in simpler hardware and less expensive fabrication. Further detail and more examples of the method for forming a variable switch signal (operating voltage) for cMUTs are disclosed in the International (PCT) Patent Application No. PCT/US/08/85025, entitled "VARIABLE OPERATING VOLTAGE IN MICROMACHINED ULTRASONIC TRANSDUCER", filed on even date with the present application and entered into the U.S. national phase as U.S. patent application Ser. No. 12/745,735 on Jun. 2, 2010. The referenced PCT patent application is hereby incorporated by reference in its entirety.

Further Embodiments of the Dual-Mode cMUT Structures

The disclosed dual-mode operation method may be applied to various cMUT structures including flexible membrane cMUTs and embedded-spring cMUTs (EScMUTs).

Figure 8A:
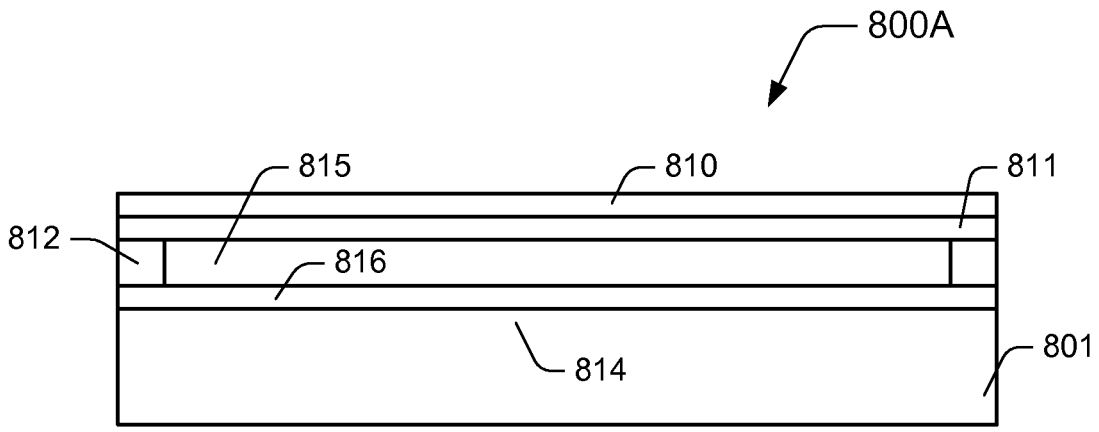
FIGS. 8A and 8B illustrate a third exemplary embodiment of the dual-mode cMUT.
Figure 8B:
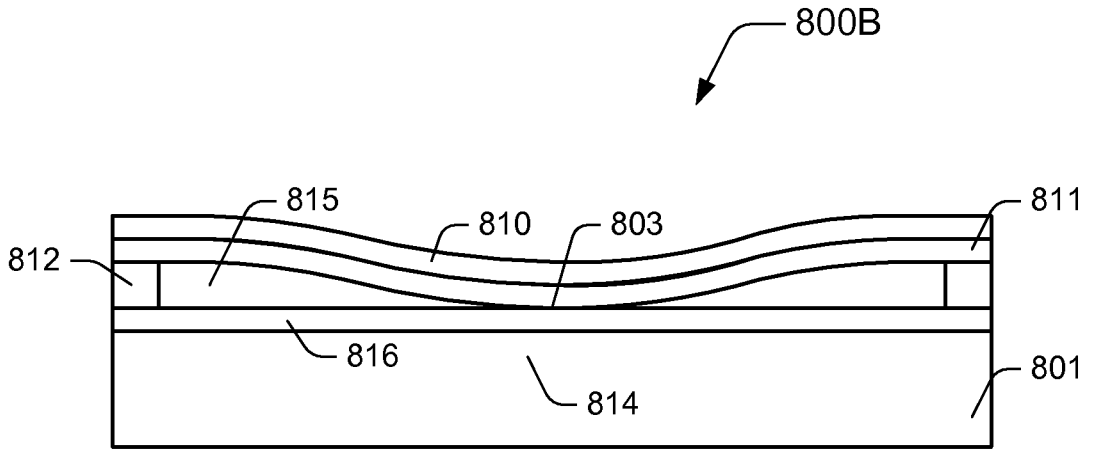

FIGS. 8A and 8B illustrate a third exemplary embodiment of the dual-mode cMUT. The cMUT is based on the flexible membrane cMUT. The cMUT 800A is the normal condition (before making contact) and the cMUT 800B is the contact operating condition (after making contact). The cMUT has a membrane 811, and anchors 812 supporting the membrane 811. A first electrode 814 supported by a substrate 801 and a second electrode 810 supported by the membrane 811 are separated from each other to define an electrode gap 815 so that a capacitance exists between the first electrode 814 and the second electrode 810. An insulation layer 816 is placed between the first electrode 814 and the second electrode layer 810. In the illustrated embodiment, the insulation layer 816 provides a bottom surface of the electrode gap 850 (the cMUT cavity in this embodiment). The cMUT does not have any specialty made contact structure. Instead, the operating condition is changed when the membrane 811 moves down to contact the surface of the first electrode 814 at the contact point 803.

The mechanical/acoustic property of a flexible membrane cMUT is mainly defined by the flexible membranes. Therefore, two operating conditions with different mechanical/acoustic properties (frequency responses) may be achieved using different switch voltage levels to set different cMUT membrane boundary condition for RX and TX operations. The different switch voltage levels change the membrane boundary condition by moving the membrane 811 to a desired position to contact the contact point 803 on the surface of the insulation layer 816. After the membrane make the contact, the equivalent cMUT membrane size becomes smaller so that the frequency response of the cMUT increases. Therefore, despite the lack of a specially made contact structure, the cMUT of FIGS. 8A and 8B, when operated using the disclosed dual-mode operation method, has the same effect as that of the cMUT of FIGS. 3A and 3B. Since the equivalent membrane size changes before and after the membrane 811 contacts with the bottom surface of the cMUT cavity (the surface of the insulation layer 816), the frequency responses of the cMUT are different the two different operating conditions 800A and 800B, which are effectuated at two different switch voltage levels as described herein.

However, the above implementation of the dual-mode cMUT based on a regular flexible membrane cMUT, although will work in principle, may potentially pose some difficulties or limitations. The membrane size of the cMUT after making the contact is not well defined because the contact area may change as the level of the applied signal changes. Also, there is no flexibility to design the size and the shape of the membrane in the contact operating condition 800B because the contact point 803 is always at or near the center. These issues may limit this design in achieving a desired frequency response for the contact operating condition 800B.

One way to further improve the performance of the dual-mode cMUT and to achieve desired frequency responses in the contact operating condition is to use one or more contact structure(s) with a designed shape and position. Specially designed contact structures may be used to determine the membrane shape of the cMUT in the contact operating condition.

Figure 9A:
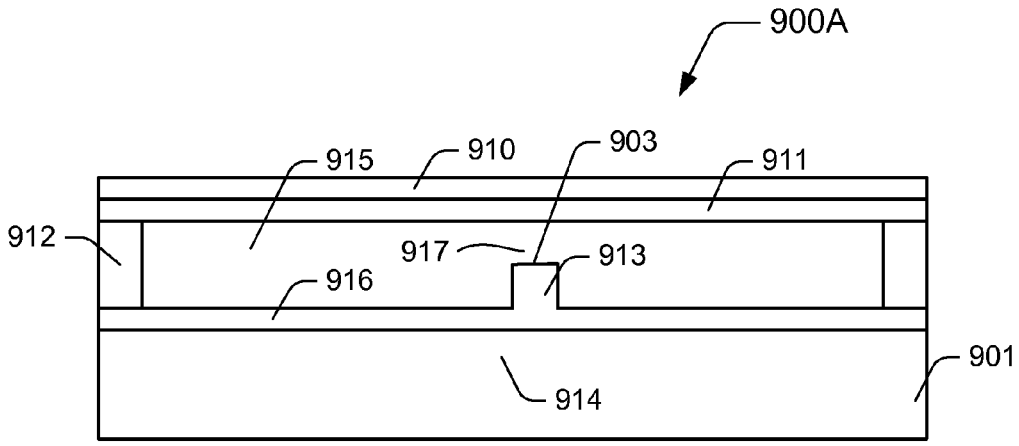
FIGS. 9A and 9B illustrate a fourth exemplary embodiment of the dual-mode cMUT.
Figure 9B:
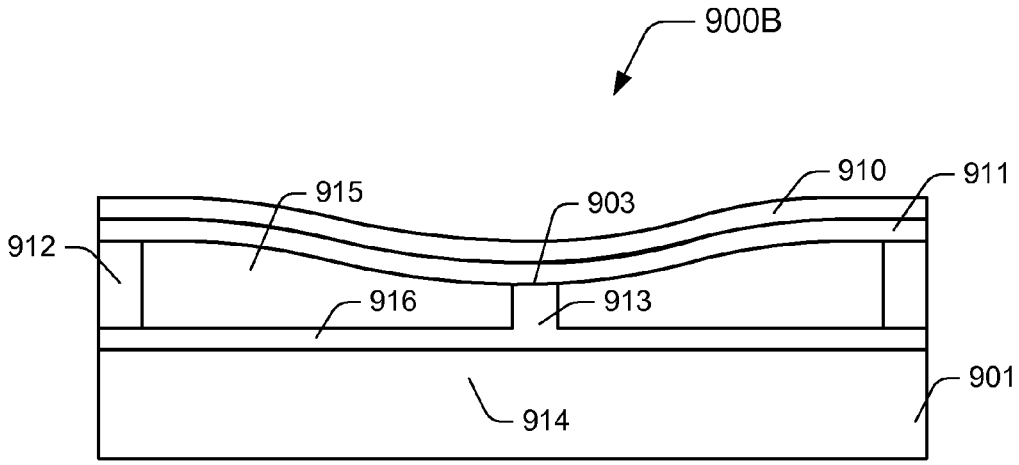

FIGS. 9A and 9B illustrate a fourth exemplary embodiment of the dual-mode cMUT. This cMUT is based on the flexible membrane cMUT and similar to the cMUT of FIGS. 8A and 8B, except that the cMUT of FIGS. 9A and 9B has a contact structure to provide a contact point instead of relying on the natural surface of the bottom of the cMUT cavity to provide the contact point. The cMUT 900A is the normal condition (before making contact) and the cMUT 900B is the contact operating condition (after making contact). The cMUT has a membrane 911, and anchors 912 supporting the membrane 911. A first electrode 914 supported by a substrate 901 and a second electrode 910 supported by the membrane 911 are separated from each other to define an electrode gap 915. An insulation layer 916 is placed between the first electrode 914 and the second electrode layer 910. A contact structure 913 is built on the insulation layer 916 to provide a contact point 903, which defines a narrower gap 917 between the contact structure 913 and membrane 911 (or the second electrode 910). Relative to the motion of the membrane 911, the contact structure 913 functions as a stopper to stop further movement of a portion of the membrane 911 that has come in contact with the contact structure 913. In the illustrated embodiment, the contact structure 913 is a post connected to the insulation layer 916 and standing thereon. The contact structures 913 may either be an integral part of the insulation layer 916 (e.g., integrally formed with the insulation layer 916 from the same fabrication material), or a part that is separately added to the insulation layer 916, or fabricated on the insulation layer 916 using an addition or a subtraction technique.

A potential advantage of the cMUT of FIGS. 9A and 9B over the cMUT of FIGS. 8A and 8B is that the contact structure 913 can be built at a selected place to more precisely define the contact point 903. In addition, the contact structure 913 may also have a selected height to more precisely define the contact operating condition. For example, the height of contact structure 913 may be selected so that the membrane 911 contacts the contact structure 913 before the pull-in (collapse) condition occurs.

Figure 10A:
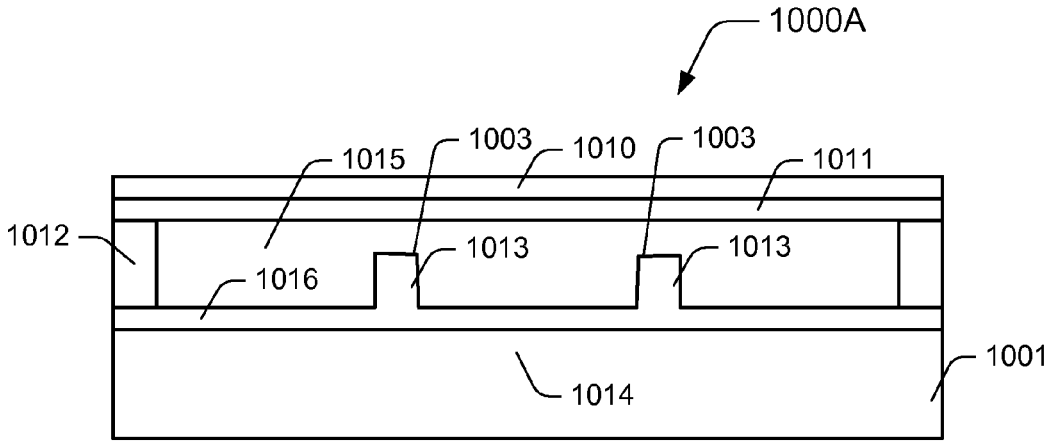
FIGS. 10A and 10B illustrate a fifth exemplary embodiment of the dual-mode cMUT.
Figure 10B:
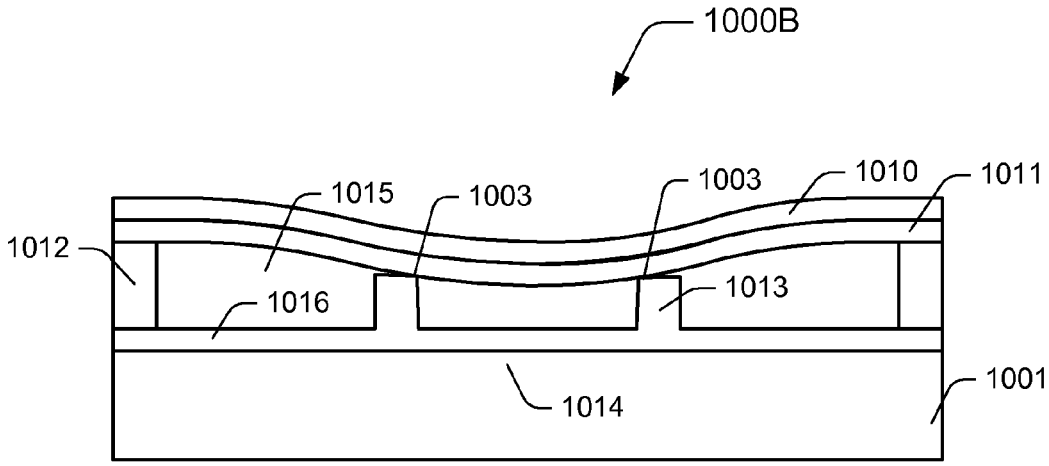

FIGS. 10A and 10B illustrate a fifth exemplary embodiment of the dual-mode cMUT. This cMUT is based on the flexible membrane cMUT and similar to the cMUT of FIGS. 9A and 9B, except that the cMUT of FIGS. 10A and 10B has two contact points 1003 spaced from each other. The contact points 1003 are provided by contact structure(s) 1013 instead of relying on the natural surface of the bottom of the cMUT cavity to provide the contact point. Depending on the design, the contact structure(s) 1013 may either be two separate structures (such as discrete posts) or parts of the same extended contact structure which only appear to be separate in the cross-section view. For example, the contact structure 1013 may be a ring shape or line shape.

The cMUT 1000A is the normal condition (before making contact) and the cMUT 1000B is the contact operating condition (after making contact). The cMUT has a membrane 1011, and anchors 1012 supporting the membrane 1011. A first electrode 1014 supported by a substrate 1001 and a second electrode 1010 supported by the membrane 1011 are separated from each other to define an electrode gap 1015. An insulation layer 1016 is placed between the first electrode 1014 and the second electrode layer 1010. Contact structure 1013 is built on the insulation layer 1016 to provide contact points 1003. Each contact point 1003 defines a narrower gap between the contact structure 1013 and membrane 1011 (or the second electrode 1010). Relative to the motion of the membrane 1011, the contact structures 1013 functions as stoppers to stop further movement of portions of the membrane 1011 that have come in contact with the contact structure 1013. In the illustrated embodiment, the contact structures 1013 include two posts spaced from each other and standing on the insulation layer 1016. Similarly, more than two posts like contact structures 1013 may be used. The posts may be distributed over an area of the insulation layer 1016 to provide further control of the frequency response of the contact operating condition 1000B.

Figure 11A:
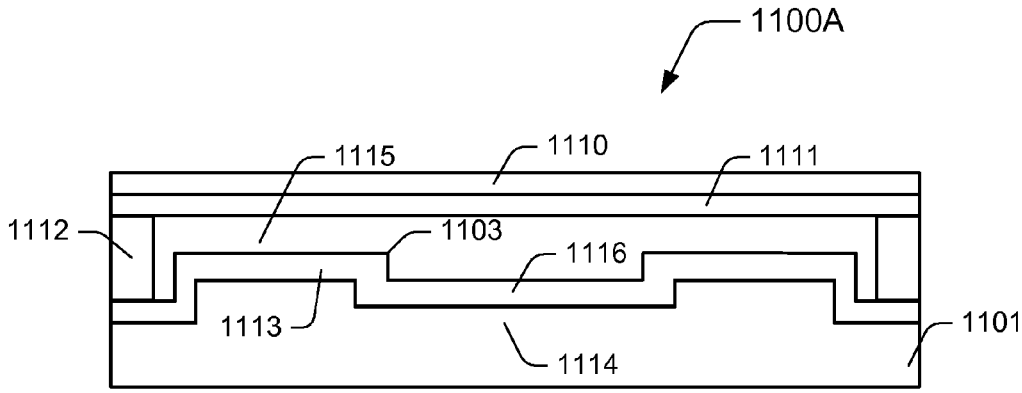
FIGS. 11A and 11B illustrate a sixth exemplary embodiment of the dual-mode cMUT.
Figure 11B:
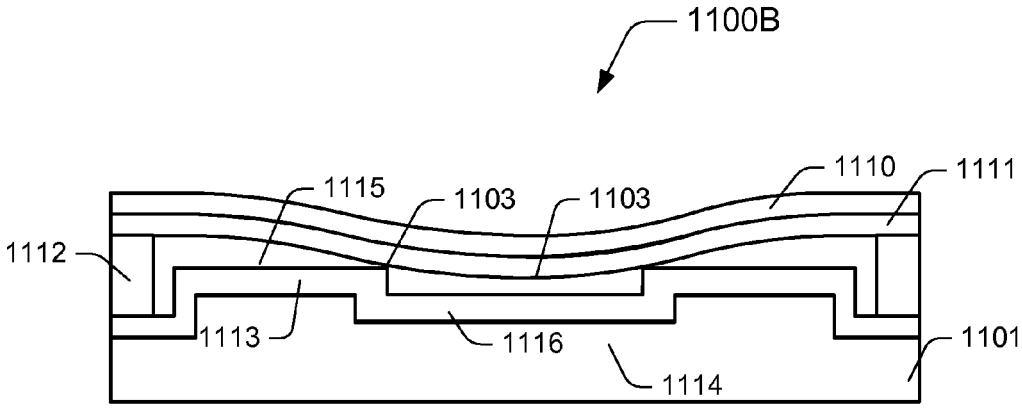

FIGS. 11A and 11B illustrate a sixth exemplary embodiment of the dual-mode cMUT. This cMUT is based on the flexible membrane cMUT, but instead of using narrower posts as contact structures, the cMUT of FIGS. 11A and 11B uses a non-flat bottom surface facing the membrane to provide contact points. The cMUT 1100A is the normal condition (before making contact) and the cMUT 1100B is the contact operating condition (after making contact). The cMUT has a membrane 1111, and anchors 1112 supporting the membrane 1111. A first electrode 1114 supported by a substrate 1101 and a second electrode 1110 supported by the membrane 1111 are separated from each other to define an electrode gap 1115. An insulation layer 1116 is placed between the first electrode 1114 and the second electrode layer 1110. The insulation layer 1116 has a non-flat surface having standing out features 1113 to provide contact points 1103. Each contact point 1103 defines a narrower gap between the standing out features 1113 and membrane 1111 (or the second electrode 1110). Relative to the motion of the membrane 1111, the standing out features 1113 functions as stoppers to stop further movement of portions of the membrane 1111 that have come in contact with the contact structure 1113. In the illustrated embodiment, the standing out features 1113 including wide steps extending higher than other areas on the insulation layer 1116.

Compared with a flat bottom surface, the non-flat bottom surface may have more flexibility to control the locations of the contact points, giving more freedom to design the frequency response of the membrane in the contact operating condition.

The shapes, locations and distribution of the contact structures and the shapes of the cMUT cavity shown in FIGS. 9-11 are just examples for illustration. Other configurations may be used to achieve a desired frequency response of the cMUT in a contact operating condition. The techniques used in the exemplary embodiments shown in FIGS. 9-11 to change the mechanical properties of the embedded spring membranes in a cMUT may also be used to achieve similar results in embedded springs cMUTs (EScMUTs) so that the EScMUT has different frequency response before and after the spring member contacts an opposing surface at a contact point, through a contact structure or a contact feature. An example of such contact structures is a post connected to the under surface of the spring member or to a bottom surface of a EScMUT spring cavity underneath the spring member.

Figure 12A:
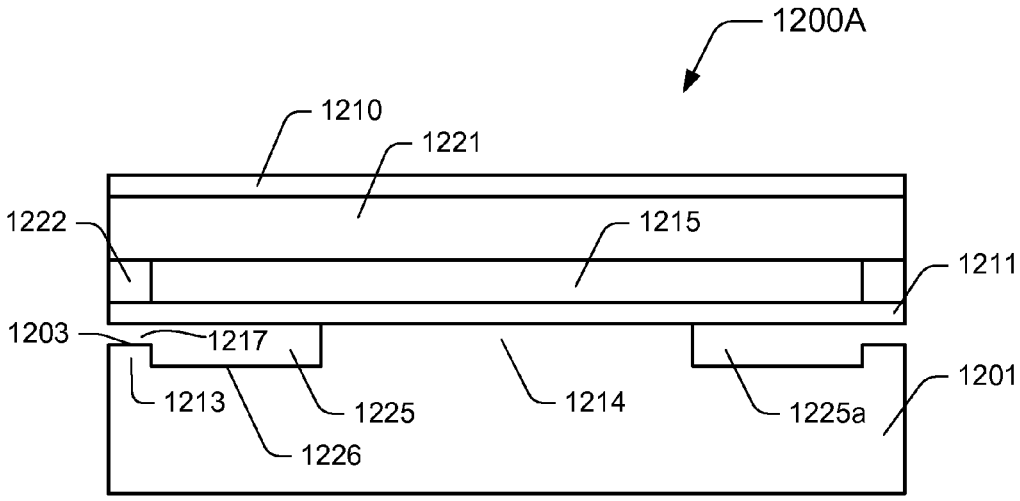
FIGS. 12A and 12B illustrate a seventh exemplary embodiment of the dual-mode cMUT.
Figure 12B:
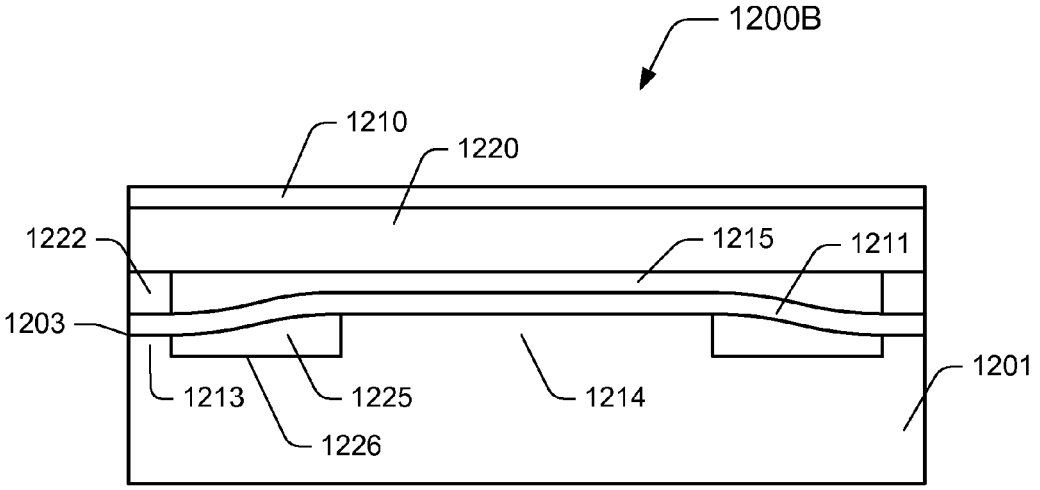

FIGS. 12A and 12B illustrate a seventh exemplary embodiment of the dual-mode cMUT. This cMUT is based on an embedded spring cMUT (EScMUT). The cMUT 1200A is the normal condition (before making contact) and the cMUT 1200B is the contact operating condition (after making contact). The cMUT has a spring layer 1211 connected to (or supported by) the first electrode 1214 supported by a substrate 1201. A second electrode 1210 is supported by a plate 1221, and suspended from the spring layer 1211 by spring-plate connectors 1222 to define the electrode gap 1215. The spring layer 1211 moves in a spring cavity 1225 which is disposed on an opposite side of the spring layer 1211 relative to the electrode gap 1215 during operation. A contact structure 1213 connected to a side 1226 of a spring cavity 1225 opposing to the spring layer 1211 to define a narrower gap 1217 between the contact structure 1213 and the spring layer 1211. Alternatively, the contact structure 1213 may be connected an underside of the spring layer 1211 facing the opposing side 1226 of the spring cavity 1225 to define a narrower gap 1217 between the contact structure 1213 and the opposing side 1226.

Alternatively, if the spring cavity 1225 is designed to be narrower than the electrode gap 1215, the contact structure 1213 may be optional. That is, the narrower gap 1217 maybe the same as the spring cavity 1225, but narrower than the electrode gap 1215. In this case, the opposing side 1226 of the spring cavity 1225 serves as an inherent stopper.

On an opposite side of the spring cavity 1225, the spring layer 1211 moves in a spring cavity 1225*a*, which may either be separated from the spring cavity 1225 or just another portion of the same circular or annular spring cavity 1225. A contact structure similar to the contact structure 1213 is also found on the side of the spring cavity 1225*a*.

The dual-mode operation methods operating a cMUT as described herein may be applied on the EScMUT of FIGS. 12A and 12B to switch the EScMUT from a normal operating condition 1200A to a contact operating condition 1200B, and vice versa. Before the contact is made, the EScMUT 1200A works in its normal piston-like operation. In the contact operating condition 1200B (e.g., at switch signal voltage level V2), a contact is made between the spring layer 1211 and the contact structure 1213 at the contact point 1203 (or between the contact structure 1213 and the opposing side 1226 of the spring cavity 1225 if the contact structure 1213 is connected to the spring layer 1211 in normal operating condition). If the contact structures 1213 and the contact points 1203 are disposed directly underneath the spring-plate connectors 1222 such that the spring-plate connectors 1222 contacts with the contact structures 1213 in a direct head-to-head manner, the spring layer 1211 is effectively immobilized and no longer plays an active function in EScMUT performance after contact. In this embodiment, in the contact operating condition, the EScMUT 1200B behaves like a flexible membrane cMUT, in which the plate 1221 serves as an equivalent flexible membrane and the spring-plate connectors 1222 serve as equivalent membrane anchors. By selecting proper dimensions and mechanical properties of the plate 1221, a desired frequency response may be obtained for the contact operating condition.

Alternatively, the contact structures 1213 and the contact points 1203 may be alternately spaced from each other across a lateral area of the spring layer 1211 such that the spring-plate connectors 1222 and the contact structures 1213 avoid direct head-to-head contact. In this implementation, the spring layer 1211 is only partially immobilized and continues to play an active function in EScMUT performance after contact but with a changed spring behavior. In this embodiment, by selecting the size and relative locations of the contact structures 1213 and the spring-plate connectors 1222, a desired frequency response may be obtained for the contact operating condition.

In addition to the deliberately designed cMUTs described herein for dual-mode operation, the disclosed dual-mode operation method may in principle be used on any cMUT that has a collapse (pull-in) state. An electrostatic transducer usually has a collapsed (pull-in) state under a collapse voltage. Using the existing cMUT operation methods, when the applied voltage is higher than the collapse voltage, the motion of the transducer loses control. Using the disclosed dual-mode operation methods, a switch signal voltage level (e.g. level V1) may be set so that the cMUT operates without collapsing, and a second switch signal voltage level (e.g. level V2) may be set high enough so that the cMUT operates after collapsing. The two operating conditions are adapted for two different cMUT operation modes (e.g., TX and RX operation modes, respectively) to take advantage of the different frequency responses of the different operating conditions.

However, although cMUTs with a collapse (pull-in) state may work in principle with the disclosed dual-mode operation methods, such configurations may not be the preferred type. During TX and RX transition periods, the cMUT experiences the collapsing process and a snap-back process. Since this process is not well controlled by input voltage signal, the unwanted ultrasound output pressure (e.g. considerably large ultrasound output with the frequency within the cMUT operating frequency region) may be generated by the switch signal to interfere with the transmission (TX) signal.

The deliberately designed cMUTs with two or more operating conditions without collapsing, such as those embodiments described in FIGS. 9-12, are therefore preferred. According to the embodiments described herein, the cMUT may be designed to be switched to a contact operating condition before it collapses. For example, the cMUT may be designed to have a switch voltage level (e.g. V2) to bring the cMUT into a contact operating condition before the cMUT collapses. The switch voltage level should generally be lower than the collapse voltage.

Methods of Operation and Applications

Figure 13:
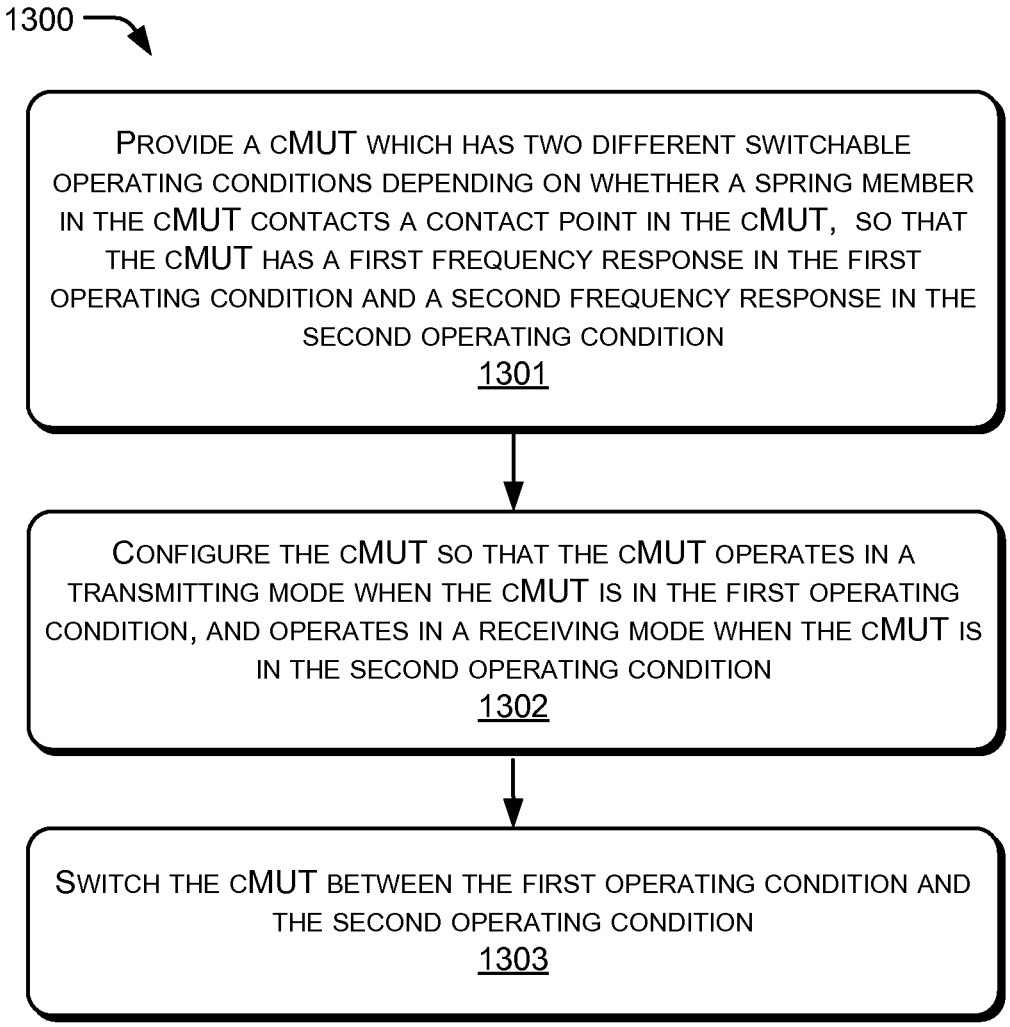
FIG. 13 illustrates a flow chart of an exemplary dual-mode operation method for operating a cMUT.

FIG. 13 illustrates a flow chart of an exemplary dual-mode operation method for operating a cMUT. The method is described as follows.

Block 1301: A cMUT is provided. The cMUT includes a spring member for enabling a first electrode and a second electrode to move toward and away from each other. The cMUT has a contact point which defines two different operating conditions of the cMUT. In the first operating condition, the contact point does not connect the spring member with an opposing surface facing the spring member. In the second operating condition, the contact point connects the spring member with the opposing surface facing the spring member, so that the cMUT has a first frequency response in the first operating condition and a second frequency response in the second operating condition. In one embodiment, the first frequency response is characterized by a first frequency band, and the second frequency response is characterized by a second frequency band substantially shifted toward a higher frequency relative to the first frequency band.

Examples of suitable cMUTs which can be provided for this purpose are described in this disclosure.

Block 1302 configures the cMUT so that the cMUT operates in a first operation mode when the cMUT is in the first operating condition, and operates in a second operation mode when the cMUT is in the second operating condition. In one embodiment, the cMUT is configured to operate in the transmission mode when the cMUT is in the first operating condition, and operates in the reception mode when the cMUT is in the second operating condition. Such configuration for dual-mode operation may be accomplished using a properly designed circuit which controls the operation of the cMUT.

Block 1303 represents a step or act which switches the cMUT between the first operating condition and the second operating condition. An exemplary way for such switch control of the cMUT operation is using a variable voltage or a switch signal, as described in further detail herein.

The dual-mode operation method is to operate a cMUT in different operating conditions in different operation modes such as RX and TX operation modes. The operating condition of a cMUT may be determined by the voltage level applied on the cMUT. The different operating conditions of the cMUT are not only indicated by different exterior conditions but also different physical statuses of the cMUT. For example, the mechanical properties or acoustic properties) of the cMUT are different in different operating conditions. The different mechanical properties or acoustic properties of a cMUT may be designed so that the cMUT has different frequency responses in different operating conditions. The difference between frequency responses may be indicated or measured by a difference of center frequencies, a difference of bandwidths or a difference of band-shapes. For example, the frequency response of the second operating condition may have a higher central frequency than the frequency response of the first operating condition, or a frequency band (bandwidth) which is broader than and/or shifted toward a higher frequency relative to of the frequency response of the first operating condition.

In one embodiment, the cMUT works in different operating conditions in TX and RX operations. As the cMUT is switched between the two different operating conditions, it also switches between the TX and RX operations. Accordingly, the cMUT may have different frequency responses in TX and RX operations.

In another embodiment, the cMUT works in different operating conditions in two different operation modes having different operating frequencies. The first operation mode has both TX and RX operations in a first frequency corresponding to the first operating condition of the cMUT, while the second operation mode has both TX and RX operations in the second frequency corresponding to be second operating condition of the cMUT.

The above described dual-mode operation methods operating a cMUT disclosed herein may be especially useful in harmonic imaging. In harmonic imaging, the dual-mode cMUT is switched between the lower frequency regular imaging (e.g., the normal operation mode) and the higher harmonic frequency imaging (e.g., the contact operation mode) using the switch methods described herein.

In yet another embodiment, the cMUT is configured to switch between a regular imaging mode and a harmonic imaging mode. In the regular imaging mode, the cMUT does not use a switching control to switch between two different operating conditions. Instead, the cMUT is used for a regular imaging in which the TX signal and RX signal are in the same frequency band. In the harmonic imaging mode, the cMUT uses a switching control to switch the dual-mode cMUT between a lower frequency mode and a harmonic frequency imaging. In other words, the switching between the regular imaging and the harmonic imaging using the dual-mode cMUT may be done by simply controlling whether to use a switch signal in imaging operation or not. If the switch signal is used, the dual-mode cMUT is in a harmonic imaging mode to perform harmonic imaging; if the switch signal is not used, the dual-mode cMUT is in a regular imaging mode to perform regular imaging.

The attenuation of the acoustic waves in a medium is usually strong at acoustic frequencies. Usually acoustic waves at lower frequencies can penetrate much further than that at higher frequencies. However, the imaging with a higher frequency acoustic wave has better resolution than that with lower frequency acoustic waves. Therefore, the imaging is preferred to be at a lower frequency for larger volume imaging, but at a higher frequency for higher resolution. The existing techniques usually use two transducers in a single ultrasound probe or two probes each with a single transducer to perform deeper imaging in the larger medium and at the same time to achieve high resolution in the medium close to the transducers. This requires switching between two transducers/probes, increases the imaging time, and also makes the position registration between two transducers/probes difficult in certain applications. The dual-mode operating methods solve this problem by allowing one transducer to work in two different frequency regions.

Alternative to operating the cMUT at one operating condition for TX and another operating condition for RX, the cMUT can also be operated at one operating condition for both RX/TX at a lower frequency and another operating condition for both RX/TX at a higher frequency. In this latter implementation, the cMUT operates like two devices with different device parameters (e.g. different frequency regions). The switch between two device modes can be done with the switch methods disclosed in present patent. The cMUT can also be operated in one operating condition for both RX/TX at a higher frequency and another operating condition for TX only at a lower frequency, or conversely, in one operating condition for both RX/TX at a lower frequency and another operating condition for TX only at a higher frequency, or in any other combinations. In particular, the cMUT may be configured to perform ultrasound imaging using both RX/TX at a higher frequency in one operation mode, and to switchably perform high intensity focused ultrasound (HIFU) operation using TX only at a lower frequency in another operation mode.

It is appreciated that the potential benefits and advantages discussed herein are not to be construed as a limitation or restriction to the scope of the appended claims.

Although the subject matter has been described in language specific to structural features and/or methodological acts, it is to be understood that the subject matter defined in the appended claims is not necessarily limited to the specific features or acts described. Rather, the specific features and acts are disclosed as exemplary forms of implementing the claims.

What is claimed is:

1. A method for operating a capacitive micromachined ultrasonic transducer (cMUT), the method comprising:

providing the cMUT including a spring member for enabling a first electrode and a second electrode to move toward and away from each other, the cMUT having a contact point which does not connect the spring member with an opposing surface facing the spring member in a first operating condition of the cMUT, and connects the spring member with the opposing surface facing the spring member in a second operating condition, so that the cMUT has a first frequency response in the first operating condition and a second frequency response in the second operating condition, wherein:

the first frequency response and the second frequency response are substantially different from each other; and a position of the contact point is controlled so that the first frequency response has a center frequency around a fundamental frequency of the cMUT, and the second frequency response has a center frequency around a harmonic frequency of the cMUT;

configuring the cMUT so that the cMUT operates in a first operation mode when the cMUT is in the first operating condition, and operates in a second operation mode when the cMUT is in the second operating condition; and switching the cMUT between the first operating condition and the second operating condition.

2. The method as recited in claim 1, wherein the first operation mode comprises one of a transmission mode and a reception mode, and the second operation mode comprises the other one of the transmission mode and the reception mode.

3. The method as recited in claim 1, wherein the first operation mode comprises transmitting and/or receiving at a first frequency, and the second operation mode comprises transmitting and/or receiving at a second frequency.

4. The method as recited in claim 3, wherein the second operation mode comprises transmitting and receiving for imaging, and the first operation mode comprises transmitting for high intensity focused ultrasound (HIFU) operation.

5. The method as recited in claim 1, wherein the first frequency response is characterized by a first frequency band, and the second frequency response is characterized by a second frequency band substantially shifted toward a higher frequency relative to the first frequency band, and wherein the first operation mode comprises a transmission mode, and the second operation mode comprises a reception mode.

6. The method as recited in claim 1, wherein the first operating condition is characterized by a first operating voltage, and the second operating condition is characterized by a second operating voltage higher than the first operating voltage.

7. The method as recited in claim 1, the cMUT being adapted for ultrasonic harmonic imaging, wherein the second operation mode comprises a reception mode to receive ultrasonic signals with harmonic frequencies.

8. The method as recited in claim 1, wherein switching the cMUT between the first operating condition and the second operating condition is accomplished using a switch signal based on a bias signal.

9. The method as recited in claim 1, wherein switching the cMUT between the first operating condition and the second operating condition is accomplished using a switch signal at least partially based on a component of a transmission input signal.

10. The method as recited in claim 1, further comprising:

switching the cMUT between a first imaging mode and a second imaging mode, wherein the first imaging mode comprises operating in the first operation mode when the cMUT is in the first operating condition, and operating in the second operation mode when the cMUT is in the second operating condition, and the second imaging mode comprises operating in one of the first operating condition and the second operating condition for all operation modes.

11. The method as recited in claim 10, wherein the first imaging mode comprises harmonic imaging.

12. A method for operating a capacitive micromachined ultrasonic transducer (cMUT), the method comprising:

providing a cMUT including a spring member for enabling a first electrode and a second electrode to move toward and away from each other, the cMUT having a contact point which does not connect the spring member with an opposing surface facing the spring member in a first operating condition of the cMUT, and connects the spring member with the opposing surface facing the spring member in a second operating condition, so that the cMUT has a first frequency response in the first operating condition and a second frequency response in the second operating condition, wherein:

the first frequency response is characterized by a first frequency band;

the second frequency response is characterized by a second frequency band substantially shifted toward a higher frequency relative to the first frequency band; and a position of the contact point is controlled so that the first frequency response has a center frequency around a fundamental frequency of the cMUT, and the second frequency response has a center frequency around a harmonic frequency of the cMUT;

configuring the cMUT so that the cMUT operates in a transmission mode when the cMUT is in the first operating condition, and operates in a reception mode when the cMUT is in the second operating condition; and switching the cMUT between the first operating condition and the second operating condition.

13. The method as recited in claim 12, the cMUT being adapted for ultrasonic harmonic imaging, wherein the reception mode receives ultrasonic signals with harmonic frequencies.

14. A capacitive micromachined ultrasonic transducer (cMUT) comprising:

a first electrode;

a second electrode separated from the first electrode by an electrode gap so that a capacitance exists between the first electrode and the second electrode;

a spring member supporting the second electrode for enabling the first electrode and the second electrode to move toward or away from each other;

a contact structure disposed on the spring member or opposing surface facing the spring member, the contact structure not connecting the spring member with an opposing surface in a first operating condition of the cMUT, and connecting the spring member with the opposing surface in a second operating condition of the cMUT, so that the cMUT has a first frequency response in the first operating condition and a second frequency response in the second operating condition, wherein:

the first frequency response and the second frequency response are substantially different from each other; and a position of the contact structure is controlled so that the first frequency response has a center frequency around a fundamental frequency of the cMUT, and the second frequency response has a center frequency around a harmonic frequency of the cMUT; and a switch for switching the cMUT between the first operating condition and the second operating condition, the first operating condition corresponding to a first operation mode, and the second operating condition corresponding to a second operation mode.

15. The cMUT as recited in claim 14, wherein the first operation mode comprises one of a transmission mode and a reception mode, and the second operation mode comprises the other one of the transmission mode and the reception mode.

16. The cMUT as recited in claim 14, wherein the first operation mode comprises transmitting and/or receiving at a first frequency, and the second operation mode comprises transmitting and/or receiving at a second frequency.

17. The cMUT as recited in claim 14, wherein the first frequency response is characterized by a first frequency band, and the second frequency response is characterized by a second frequency band substantially shifted toward a higher frequency relative to the first frequency band.

18. The cMUT as recited in claim 17, wherein the first operation mode comprises a transmission mode, and the second operation mode comprises a reception mode.

19. The cMUT as recited in claim 14, wherein the first operating condition is characterized by a first operating voltage, and the second operating condition is characterized by a second operating voltage higher than the first operating voltage.

20. The cMUT as recited in claim 14, wherein the spring member is space from the first electrode and moves together with the second electrode in the electrode gap during operation, and the contact structure comprises a stopper connected to one of the first electrode and the second electrode to define a narrower gap between the stopper and the other one of the first electrode and the second electrode.

21. The cMUT as recited in claim 14, wherein the contact structure provides at least two contact points spaced from each other, the contact points defining a narrower gap between the contact structure and one of the first electrode and the second electrode.

22. The cMUT as recited in claim 14, wherein the spring member is connected to the first electrode, the second electrode is suspended from the spring member by a support member to define the electrode gap, and the spring member moves in a spring cavity on an opposite side of the spring member relative to the electrode gap during operation, and wherein the contact structure comprises a stopper connected to one of the spring member and an opposing side of the spring cavity to define a narrower gap between the stopper and the other one of the spring member and the opposing side of the spring cavity.

23. The cMUT as recited in claim 14, wherein the spring member is connected to the first electrode, the second electrode is suspended from the spring member by a support member to define the electrode gap, and the spring member moves in a spring cavity on an opposite side of the spring member relative to the electrode gap during operation, and wherein the contact structure provides at least two contact points spaced from each other, the contact points defining a narrower gap between the contact structure and one of the spring member and the opposing side of the second spring cavity.

24. The cMUT as recited in claim 14, the cMUT being adapted for ultrasonic harmonic imaging, wherein the second operation mode comprises a reception mode to eceive ultrasonic signals with harmonic frequencies.

* * * * *